US009367979B2

(12) United States Patent
Neilan

(10) Patent No.: US 9,367,979 B2
(45) Date of Patent: Jun. 14, 2016

(54) MEDIA COUNT REPLENISHMENT MANAGEMENT

(71) Applicant: Michael James Neilan, Dundee (GB)

(72) Inventor: Michael James Neilan, Dundee (GB)

(73) Assignee: NCR Corporation, Duluth, GA (US)

( * ) Notice: Subject to any disclaimer, the term of this patent is extended or adjusted under 35 U.S.C. 154(b) by 21 days.

(21) Appl. No.: 13/967,999

(22) Filed: Aug. 15, 2013

(65) Prior Publication Data

US 2015/0051731 A1 Feb. 19, 2015

(51) Int. Cl.
*G07D 11/00* (2006.01)
*G07F 19/00* (2006.01)

(52) U.S. Cl.
CPC ..... *G07D 11/0057* (2013.01); *G07F 19/209* (2013.01)

(58) Field of Classification Search
CPC ..... G07D 11/0057; G07F 19/209; G07F 19/2019
USPC ..... 235/379
See application file for complete search history.

(56) References Cited

U.S. PATENT DOCUMENTS 6,378,770 B1 * 4/2002 Clark et al. ..... 235/379
7,219,083 B2 * 5/2007 Bellucci ..... G06Q 20/06 235/379
2010/0082355 A1 * 4/2010 Folk et al. ..... 705/1
2011/0106681 A1 * 5/2011 Cockerell et al. ..... 705/35
2014/0339301 A1 * 11/2014 Angus ..... G06Q 40/04 235/379

* cited by examiner

*Primary Examiner* — Toan Ly
(74) *Attorney, Agent, or Firm* — Schwegman, Lundberg & Woessner

(57) ABSTRACT

A method of managing media counts at a media terminal is described. The method comprises: receiving an expected media count from a remote management application; detecting a media replenisher at the media terminal; providing the expected media count to the media replenisher; and receiving confirmation from the media replenisher that the expected media count corresponds to the actual media present.

18 Claims, 3 Drawing Sheets

MEDIA COUNT REPLENISHMENT MANAGEMENT

FIELD OF INVENTION

The present invention relates to managing media counts. In particular, although not exclusively, the invention relates to managing counts of media in the form of banknotes at a media terminal, such as an automated teller machine (ATM).

BACKGROUND OF INVENTION

ATMs need periodic replenishment so that they can continue to dispense cash to customers. Owners of large ATM networks typically use cash optimization techniques to ensure that the cash distributed throughout a bank's network (which includes the bank's ATMs) is optimally located to maintain availability of cash and to minimize cash replenishment operations, without requiring large amounts of surplus cash (which is expensive) to be located within the network.

When a cash-in-transit (CIT) company replenishes banknotes at an ATM, the CIT personnel manually enters (by typing in) the amount of cash being replenished via a management application executing on the ATM. This is referred to as the Initial Cash Amount Totals.

Sometimes, however, CIT personnel do not type in the correct amount of banknotes that were provided in the replenishment operation. This means that the ATM has the wrong tally of banknotes present.

This has two negative consequences.

Firstly, a transaction host is used to record transactions executed at the ATM and to maintain counts of the banknotes remaining in the ATM. If the wrong initial amount is provided then the transaction host will be out of synchronization with the ATM.

Secondly, this can result in the ATM running out of cash before the next scheduled replenishment (if the CIT personnel typed in more than the actual amount of banknotes that were provided) or having excess cash that is removed from the ATM (if the CIT personnel typed in less than the actual amount of banknotes that were provided). This also slows down auditing and cash balancing/reconciliation of the ATM because an incorrect cash reference is used.

SUMMARY OF INVENTION

Accordingly, the invention generally provides methods, systems, and software for managing media counts.

In addition to the Summary of Invention provided above and the subject matter disclosed below in the Detailed Description, the following paragraphs of this section are intended to provide further basis for alternative claim language for possible use during prosecution of this application, if required. If this application is granted, some aspects may relate to claims added during prosecution of this application, other aspects may relate to claims deleted during prosecution, other aspects may relate to subject matter never claimed. Furthermore, the various aspects detailed hereinafter are independent of each other, except where stated otherwise. Any claim corresponding to one aspect should not be construed as incorporating any element or feature of the other aspects unless explicitly stated in that claim.

According to a first aspect there is provided a method of managing media counts at a media terminal, the method comprising: receiving an expected media count from a remote management application; detecting a media replenisher at the media terminal; providing the expected media count to the media replenisher; and receiving confirmation from the media replenisher that the expected media count corresponds to the actual media present.

The media terminal may comprise a self-service terminal, an assisted service terminal, or the like. The self-service terminal may comprise an automated teller machine.

Receiving an expected media count from a remote management application may be implemented by a management agent receiving the expected media count.

Detecting a media replenisher at the self-service terminal may be implemented by detecting a change in state of a switch (which may be a mechanical or electronic switch), change in state of a sensor (such as a currency cassette full sensor, a cassette empty sensor, a cassette low sensor, an interlock sensor changing state, or the like), detecting presence of a security token (such as a card, a dongle, or the like), detecting entry of information (such as a username and passcode combination), sensing a menu selection (such as a replenishment option), or the like.

The switch may be used to change the operation of the terminal from performing transactions to performing servicing functions. The switch may comprise a supervisor switch on an automated teller machine.

Providing the expected media count to the media replenisher may be implemented by (i) the management agent communicating the expected media count to a local application, and (ii) the local application populating a screen with the expected media count when the media replenisher selects a media replenishment function using the local application.

The local application may be a supervisor application operable to allow an authorized user to configure and maintain the media terminal.

The supervisor application may include, or access, a system application operable to facilitate access to diagnostic information and to provide servicing functions (such as performing self-tests on devices installed in the media terminal). An example of a suitable system application may be the "SysApp" application, available from NCR Corporation, the assignee of this patent application. Another suitable application may be "Branch Aid" software, also available from NCR Corporation.

The method may comprise the further steps of (i) receiving an entry from the media replenisher that indicates that the actual media present does not correspond to the expected media count, and (ii) receiving information from the media replenisher indicating the actual amount of media present.

The method may comprise the further step of either: (i) updating a media count using the expected media count if the expected media count was confirmed by the media replenisher, or (ii) updating a media count using the information from the media replenisher indicating the actual amount of media present, if the expected media count was annulled by the media replenisher.

The remote management application may implement a media optimization function to decide how much media should be located at the media terminal.

The remote management application may also implement a media terminal management function so that the remote management application receives event and fault information from the media terminal, and may dispatch a service engineer to service (including preventative maintenance and repair) the media terminal.

The media terminal may comprise an automated teller machine, and the media may comprise cash (such as banknotes or coins). Alternatively, the media may comprise stamps, coupons, tickets, or the like.

The management agent may be a distributed management agent comprising an agent core and a plurality of collector agents. A collector agent may be associated with the local application or a media dispenser located within the media terminal.

The method may comprise the further step of transmitting the actual amount of media present to a remote transaction host. The remote transaction host may maintain a record of every transaction performed by the media terminal, and may also maintain a current total of media within that media terminal.

The remote transaction host may also perform the function of the remote management application. In other words, the functions of the remote management application may also be implemented by the remote transaction host.

The method may further comprise updating a local application with the actual amount of media present (which may be the expected media count, if confirmed by the media replenisher, or the amount typed in (or otherwise entered) by the media replenisher if the expected media count was annulled by the media replenisher).

According to a second aspect there is provided a media terminal comprising (i) a media dispenser, (ii) a service application operable to provide service functions to an authorized user of the terminal and operable to: receive an expected media count from a remote management application; detect a media replenisher at the media terminal; provide the expected media count to the media replenisher; and receive confirmation from the media replenisher that the expected media count corresponds to the actual media present in the terminal.

The service application may include a management agent executing on the terminal and operable to communicate with the media dispenser.

The management agent may comprise: an agent core, a plurality of collector components, and a transfer service.

The agent core may comprise: an agent configuration component; a rules engine component; a scheduling component; and an event filtering component.

A collector component may be associated with the media dispenser. Other collector components are envisioned, and these may be associated with an XFS interface, a local application (such as the supervisor application and/or a system application), and the like.

The transfer service component may be used to facilitate communications between the remote management application and the agent core.

The transfer service component may implement a known communications technology. For example, the transfer service may implement simple network management protocol (SNMP), Web services, a Background Intelligent Transfer Service (BITS), or the like.

The media terminal may comprise an automated teller machine, a self-checkout terminal, a payment terminal, or the like.

The agent core may be operable to update a collector component associated with the media dispenser with the actual amount of media present.

The service application may be operable to detect a media replenisher in a number of different ways. For example, a media replenisher may be detected by detecting a change in state of a switch (which may be a mechanical or electronic switch), change in state of a sensor (such as a currency cassette full sensor, a cassette empty sensor, a cassette low sensor, an interlock sensor changing state, or the like), detecting presence of a security token (such as a card, a dongle, or the like), detecting entry of information (such as a username and passcode combination), sensing a menu selection (such as a replenishment option), or the like.

The switch may be used to change the operation of the terminal from performing transactions to performing servicing functions. The switch may comprise a supervisor switch on an automated teller machine.

The service application may be operable to provide the expected media count to the media replenisher by populating a screen with the expected media count when the media replenisher selects a media replenishment function using the service application.

The service application may include a supervisor application operable to facilitate access to configuration and maintenance functions at the media terminal.

The management agent may be an enhanced version of the Unified Agent available from NCR Corporation.

The service application may be further operable to (i) receive an event triggered by an entry from the media replenisher, where the event indicates that the actual media present does not correspond to the expected media count, and (ii) receive information from the media replenisher indicating the actual amount of media present.

The service application may be further operable to: (i) update a media count using the expected media count if the expected media count was confirmed by the media replenisher, or (ii) update a media count using the information from the media replenisher indicating the actual amount of media present, if the expected media count was annulled by the media replenisher.

The remote management application may implement a media optimization function to decide how much media should be located at the media terminal.

The remote management application may also implement a media terminal management function so that the remote management application receives event and fault information from the media terminal, and may dispatch a service engineer to service the media terminal.

The media terminal may comprise a self-service terminal or an assisted service terminal. The self-service terminal may comprise an automated teller machine, and the media may comprise cash (such as banknotes or coins).

The management agent may be a distributed management agent comprising an agent core and a plurality of collector agents. A collector agent may be associated with the local application or a media dispenser located within the media terminal.

The service application may also be operable to transmit the actual amount of media present to a remote transaction host. The remote transaction host may maintain a record of every transaction performed by the media terminal, and may also maintain a current total of media within that media terminal.

The remote transaction host may also perform the function of the remote management application. In other words, the functions of the remote management application may also be implemented by the remote transaction host.

According to a third aspect there is provided a management agent for executing on a terminal comprising a media dispense device, wherein the management agent is programmed to: (i) receive an expected media count from a remote management application; (ii) provide the expected media count to a media replenisher; and (iii) receive confirmation from the media replenisher that the expected media count corresponds to the actual media present.

The management agent may provide the expected media count to the media replenisher directly; for example, using wireless communication with a portable device (such as a cellular telephone) carried by the media replenisher. Alternatively, the management agent may provide the expected media count to the media replenisher indirectly; for example, via a local application presenting the expected media count on a display of the terminal.

Similarly, the management agent may receive confirmation from the media replenisher that the expected media count corresponds to the actual media present directly (for example, via the portable device) or indirectly (for example, via the local application).

For clarity and simplicity of description, not all combinations of elements provided in the aspects recited above have been set forth expressly.

Notwithstanding this, the skilled person will directly and unambiguously recognize that unless it is not technically possible, or it is explicitly stated to the contrary, the consistory clauses referring to one aspect are intended to apply mutatis mutandis as optional features of every other aspect to which those consistory clauses could possibly relate.

These and other aspects will be apparent from the following specific description, given by way of example, with reference to the accompanying drawings.

DETAILED DESCRIPTION

Figure 1:
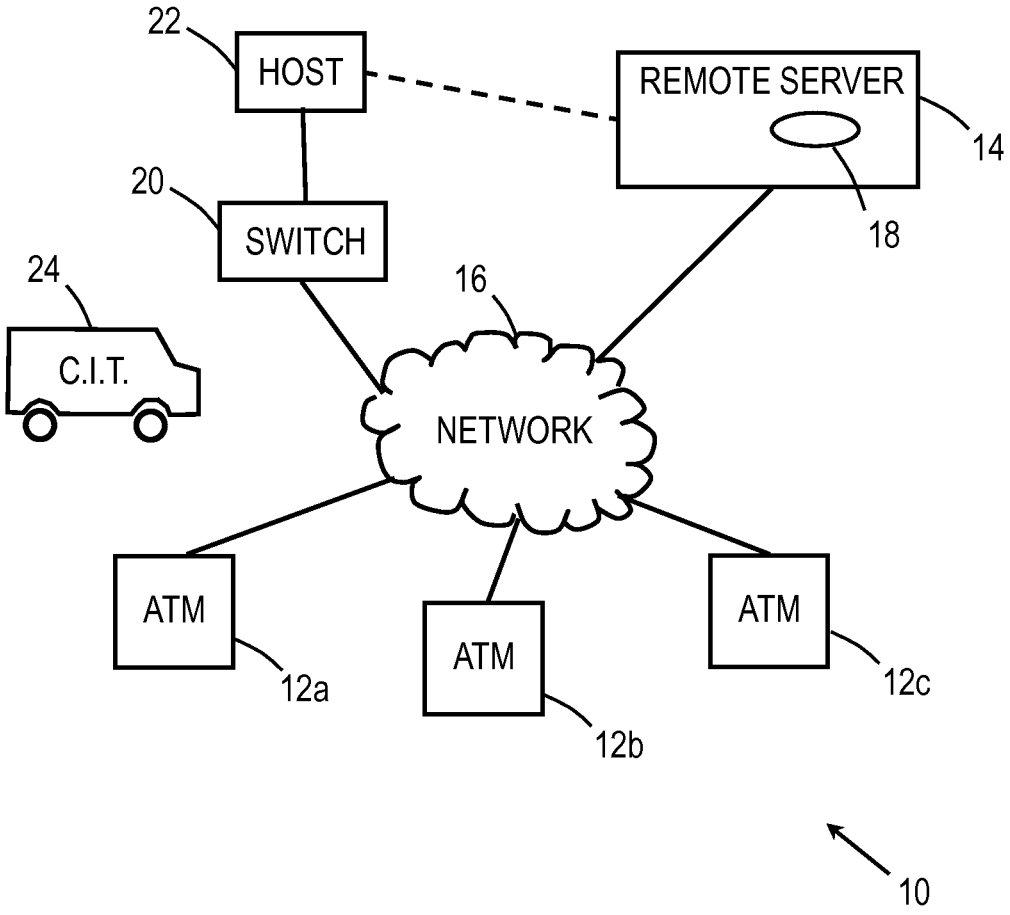
FIG. 1 is a simplified block diagram illustrating a system for managing media counts according to one embodiment of the present invention.

Reference is first made to FIG. 1, which is a block diagram illustrating a system 10 for managing media counts (in particular cash counts) according to one embodiment of the present invention.

The system 10 comprises a plurality of media terminals 12 (only three of which are illustrated in FIG. 1) in the form of automated teller machines (ATMs) coupled to a remote management server 14 by an Internet Protocol (IP) network 16. A management application 18 executes on the remote management server 14 and is used to monitor the status and performance of the ATMs 12 in the system 10, and to schedule maintenance and replenishment operations for these ATMs 12.

The management application 18 also includes cash optimization software. In this embodiment the cash optimization software is NCR APTRA OptiCash (trademark), available from NCR Corporation.

NCR APTRA OptiCash is an advanced cash management solution that predicts the demand for currency at each cash point (such as the ATMs 12) on an individual basis. By applying sophisticated mathematical algorithms to historical, event and cost data, the optimum cash position and delivery schedule for each cash point (or each currency cassette or cash drawer within a cash point) is determined.

The system 10 also comprises a conventional transaction switch 20 and an authorization server 22 (also referred to as a transaction host or an authorization host). As is known in the art, the transaction switch 20 is used to route transactions requested by a customer at one of the ATMs to a financial institution that maintains an account for that customer. For any transactions requested by customers of the owner of the system 10 (referred to as "on-us" transactions), the authorization server 22 provides the authorization approval or denial. For other transactions ("not-on-us" transactions) the transaction switch 20 routes the transaction request to an appropriate interchange network (not shown) for approval, as is known to those of skill in the art.

The authorization server 22 also stores account information for all of the customers of the financial institution that owns or operates the system 10, and also stores information about each ATM 12 (such as the cash totals, total amount dispensed since last replenishment, and the like). In this embodiment, the authorization server 22 is a conventional, unmodified, authorization server 22.

A media replenisher 24, in the form of a cash-in-transit (or CIT) person, is illustrated in a vehicle that visits the ATMs 12 according to a defined schedule or in response to the ATM 12 running low or out of cash. The media replenisher 24 is not part of the system 10 but provides replenishment services thereto.

Figure 2:
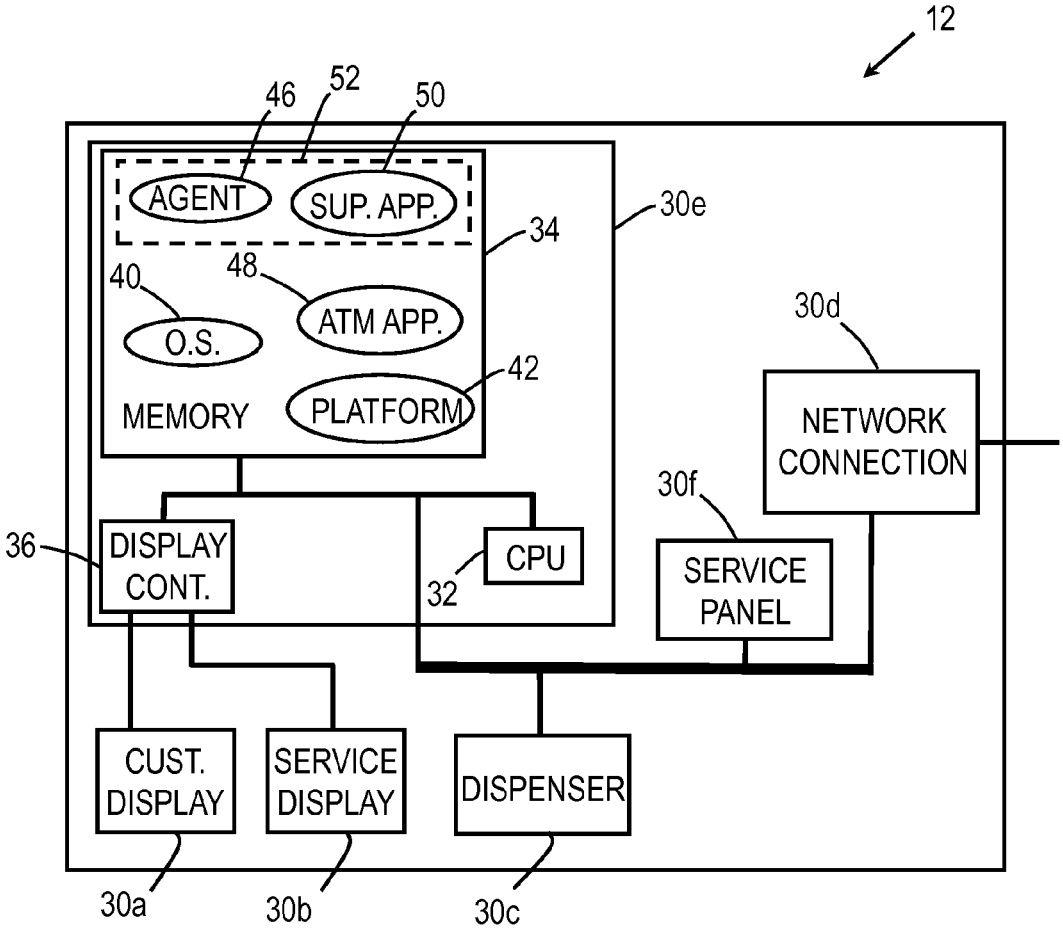
FIG. 2 is a simplified block diagram illustrating one of the terminals (one of the ATMs) of the system of FIG. 1 in more detail.

Reference is now also made to FIG. 2, which is a simplified block diagram illustrating one of the ATMs 12 of FIG. 1 in more detail.

Each ATM 12 includes a plurality of managed devices 30, only some of which are shown in FIG. 2. As used herein, the phrase "managed device" has a broad meaning that encompasses software components, hardware components, and combined software and hardware components.

The managed devices include: a customer display 30*a*, a service display 30*b* (visible to an authorized person, such as the media replenisher 24 or a service engineer, when they open the ATM 12 to operate on it), a cash dispenser device 30*c*; a network device 30*d* for connecting to the IP network 16; a controller device 30*e* (in the form of a PC core) for controlling the operation of the ATM 12, including the operation of other managed devices (not shown for simplicity of description), and a service panel 30*f* for used by authorized personnel (as described in more detail below).

The controller 30*e* comprises a microprocessor (CPU) 32, associated main memory 34, and a display controller 36 in the form of a graphics card. The display controller 36 controls both the customer display 30*a* and the service display 30*b*.

During operation of the ATM 12, various software components are loaded into, and execute in, the memory 34. These components include a conventional operating system 40 (in this embodiment a Microsoft (trade mark) Windows 7 (trade mark) operating system), platform components 42 for enhancing and extending the operating system for non-standard devices (such as the cash dispenser 30*c* and the like), a distributed management agent 46, an ATM transaction application 48, and a supervisor application 50. The distributed management agent 46 and the supervisor application 50 together provide a service application 52.

The ATM 12 implements the CEN XFS standard, and the platform components 42 include XFS service providers (not shown individually) for the managed devices 30; for example, there is an XFS cash dispenser service provider.

The management agent 46 includes various collector components (not shown). Each collector component is associated with at least one managed device (such as the cash dispenser 30*c*, the network device 30*d*, and the like). The management agent 46 also comprises an agent core (not shown) that communicates with all of the collector components. The management agent 46 also includes a transfer service component (not shown) that manages communication between the agent core and the management application 18 (FIG. 1). The combination of the agent core, the various collector components, and the transfer service component comprise the management agent 46.

As is known in the art, the ATM application 48 controls the operation of the ATM 12 to allow customers to execute transactions. The supervisor application 50 controls the operation of the ATM 12 to allow authorized personnel to service the ATM 12 (including maintaining the ATM 12, diagnosing faults in the ATM 12, and replenishing the ATM 12 with cash and printer paper).

Figure 3:
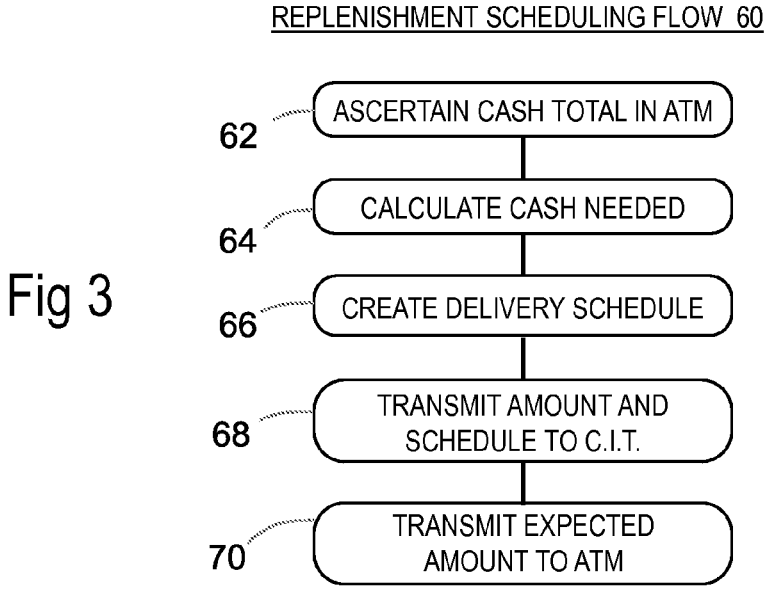
FIG. 3 is a flowchart illustrating steps performed by a part (a management application) of the system of FIG. 1 in calculating and scheduling cash replenishment for the ATM of FIG. 2.

Reference will now also be made to FIG. 3, which is a flowchart 60 illustrating steps performed by the management application 18 in calculating and scheduling cash replenishment for the ATMs 12 in the system 10.

The first step (step 62) is for the remote management application 18 to ascertain the current cash total in each ATM 12. This is performed for all of the ATMs 12 in the system 10, but is only described for one ATM 12 for simplicity of description and ease of understanding.

The remote management application 18 may ascertain the amount of cash in one or more of a plurality of different ways. For example, the remote management application may ascertain the amount of cash by sending a query to the management agent 46, by sending a query to the authorization server 22, it may store the amount locally and update the amount after each transaction, by receiving a scheduled communication from the management agent 46, or it may ascertain the amount of cash in ATM 12 in any other convenient manner.

The next step is to use the cash optimization software in the remote management application 18 to predict how much cash needs to be provided to the ATM 12 (step 64). The amount of cash needed may comprise a total for each currency cassette in the ATM 12 and/or a total for each denomination provided.

The next step is to use the cash optimization software in the remote management application 18 to predict when the cash should be delivered to the ATM 12 (that is, a delivery schedule is created) (step 66). The delivery schedule may depend on how much cash remains in the other ATMs 12, when those other ATMs 12 will need replenished, what other devices (for example, tellers) in the same geographic area need replenishment, and the like.

The remote management application 18 then transmits the cash amount required and the delivery schedule to a CIT (step 68) as a cash order. Alternatively, the remote management application 18 may send a notification to a branch in which the ATMs 12 are located to authorize the branch staff to perform replenishment of the ATMs 12 (for example, using currency stored in a vault in the branch).

The remote management application 18 also transmits the cash amount ordered (from the CIT) and the delivery schedule to the ATM 12 (in particular, to the management agent 46) (step 70).

Figure 4:
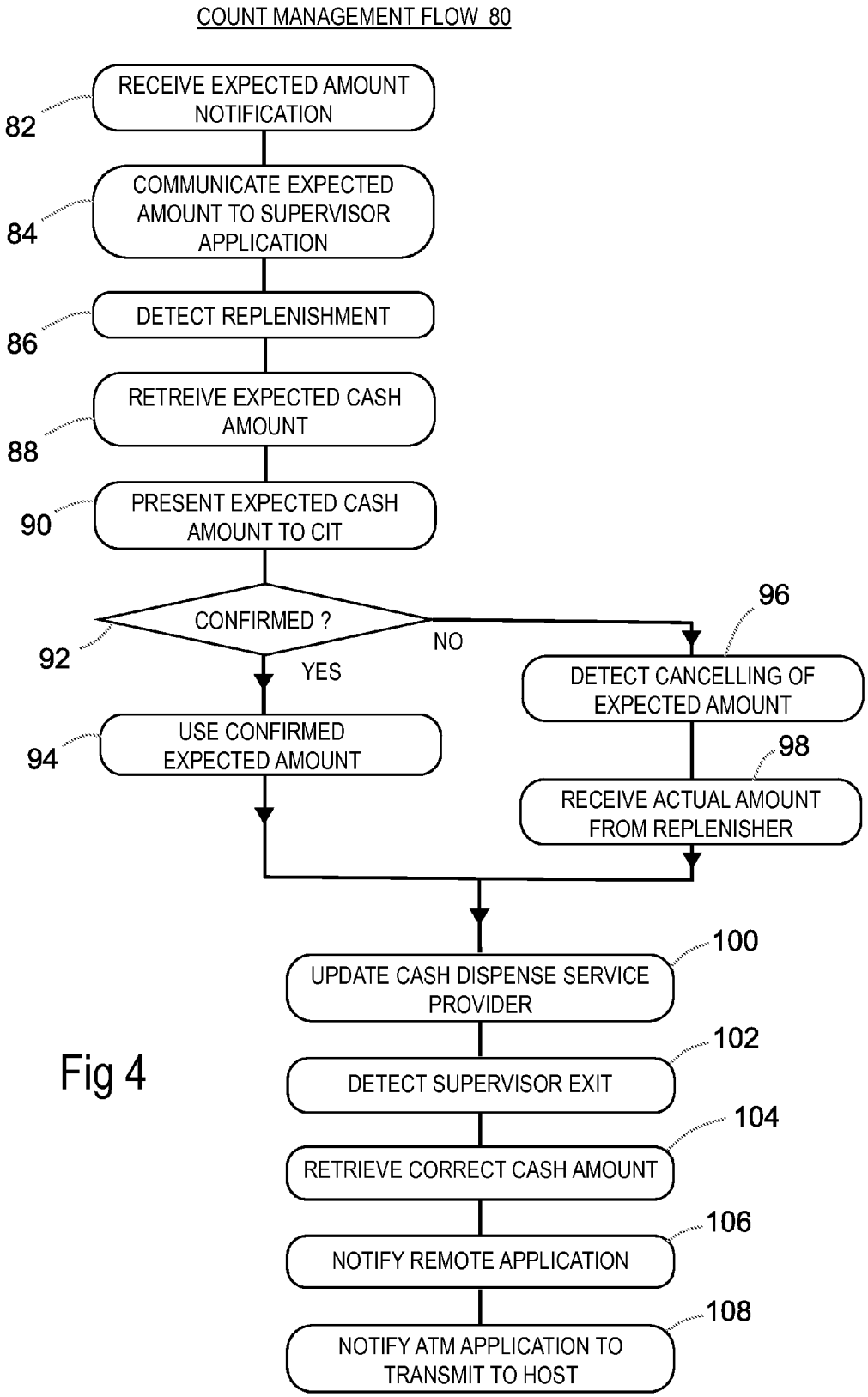
FIG. 4 is a flowchart 70 illustrating steps performed by the ATM of FIG. 2 in response to the scheduled cash replenishment described in FIG. 3.

Reference will now also be made to FIG. 4, which is a flowchart 80 illustrating steps performed by the ATM 12 in response to the scheduled cash replenishment described in the replenishment scheduling flow 60. The flowchart 80 describes the count management flow.

Initially, the management agent 46 receives the expected cash amount and the delivery schedule (step 82).

The management agent 46 communicates this expected amount to the supervisor application 50 (step 84). The supervisor application 50 or the management agent 46 may communicate this amount to a service provider associated with the cash dispenser 30*c*.

At this point, there may be a delay until the scheduled replenishment occurs.

When the CIT person 24 (or branch staff in the event that branch staff perform a top-up of cash at the ATM 12) arrives at the ATM 12, he/she accesses the service panel 30*f* and presses a supervisor switch, which puts the ATM 12 out of service and initiates the supervisor application 50. When this occurs, the supervisor application 50 presents a graphical user interface to the CIT person 24 on the service display 30*b*.

At this point, the person who pressed the supervisor switch may be present to correct a fault (if a fault has occurred), to perform routine maintenance, or to replenish the cash. In this example, the CIT person 24 is present to replenish the cash.

One of the menu options provided to the CIT person 24 relates to replenishment. When the CIT person 24 selects this replenishment menu option, the supervisor application 50 detects this (step 86).

In response to this selection, the supervisor application 50 retrieves the expected cash amount (which it stored internally) (step 88).

The supervisor application 50 then presents the expected cash amount to the CIT person 24 on the service display 30*b* (step 90) and invites the CIT to confirm or annul the expected cash amount (step 92).

If the CIT person 24 replenished the ATM 12 with the expected amount, then the CIT person 24 approves the expected cash amount and the supervisor application 50 uses the expected cash amount as the actual cash amount stored in the ATM 12 (step 94).

If the CIT person 24 replenished the ATM 12 with a different amount to the expected amount (for example, the CIT person 24 may have removed some cash from partially empty currency cassettes within the ATM 12 and added the removed cash to the expected amount of cash), then the CIT person 24 annuls the expected cash amount, which the supervisor application 50 detects (step 96).

The supervisor application 50 then provides a screen on the service display 30*b* that allows the CIT person 24 to type in (or select) the actual amount of cash in the ATM 12, which the supervisor application 50 receives (step 98).

Once the CIT person 24 has either confirmed the expected cash amount, or entered the actual cash amount (if different from the expected cash amount), the next step is for the supervisor application 50 to update the cash dispenser XFS service provider (not shown individually, but part of the platform components 42) with the correct cash amount to be used as the XFS initial count (step 100).

Once the CIT person 24 exits the supervisor application 50 then the management agent 46 detects this (step 102) and retrieves the correct cash amount from the cash dispenser XFS service provider (step 104).

The management agent 46 will then communicate the correct cash amount in the ATM 12 to the remote management application 18 (step 106), which uses the correct cash amount to update its records and to compare the correct cash amount with the amount of cash for which the CIT company invoices the financial institution.

The ATM application 48 has access to the cash dispenser XFS service provider (which stores the correct cash amount), so the ATM application 50 can use the correct cash amount to notify the authorization server 22 of the new cash total for that ATM 12 (that is, the correct cash amount) (step 108). Typically, when the supervisor application 50 is exited, control of the ATM 12 is returned to the ATM application 48.

Alternatively, the supervisor application 50 may be able to notify the authorization server 22 directly (prior to the CIT person 24 exiting the supervisor application 50); for example, the notification may be implemented by the CIT person 24 selecting an option in the supervisor application 50 to transmit the updated cash totals to the authorization server 22.

It should now be appreciated that this embodiment has the advantage of reducing possible error by the CIT person 24 by providing the expected cash amount for the CIT person 24 to confirm, rather than relying on the CIT person 24 to type in or select the correct amount. Only if the actual amount differs from the expected amount does the CIT person 24 have to enter manually the correct amount of cash that he/she loaded into the ATM 12.

Various modifications may be made to the above described embodiment within the scope of the invention, for example, in other embodiments, media terminals other than ATMs, or networks other than SSTs (for example, point of sale (PoS) terminal networks, assisted service terminal networks, mixed PoS, assisted service, and ATM networks, or the like), may be used to implement the media count management function.

In other embodiments, the management application 18 may execute on the authorization server 22 instead of on the remote management server 14 (there may be no remote management server 14).

In other embodiments, the supervisor application may be accessed in a different way to that described above. For example, the supervisor application may be launched automatically when a front or rear cover of the ATM 12 is opened.

The steps of the methods described herein may be carried out in any suitable order, or simultaneously where appropriate. The methods described herein may be performed by software in machine readable form on a tangible storage medium or as a propagating signal.

The terms "comprising", "including", "incorporating", and "having" are used herein to recite an open-ended list of one or more elements or steps, not a closed list. When such terms are used, those elements or steps recited in the list are not exclusive of other elements or steps that may be added to the list.

Unless otherwise indicated by the context, the terms "a" and "an" are used herein to denote at least one of the elements, integers, steps, features, operations, or components mentioned thereafter, but do not exclude additional elements, integers, steps, features, operations, or components.

The presence of broadening words and phrases such as "one or more," "at least," "but not limited to" or other similar phrases in some instances does not mean, and should not be construed as meaning, that the narrower case is intended or required in instances where such broadening phrases are not used.

Features, integers, characteristics or groups described in conjunction with a particular aspect, embodiment or example of the invention are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of the features and/or steps are mutually exclusive.

The reader's attention is directed to all papers and documents which are filed concurrently with or previous to this specification in connection with this application and which are open to public inspection with this specification, and the contents of all such papers and documents are incorporated herein by reference.

What is claimed is:

1. A method of managing media counts at a media terminal, the method comprising:

receiving an expected media count from a remote management application, where the expected media count is the amount of cash needed by the media terminal for operation;

detecting a media replenisher at the media terminal;

providing the expected media count to the media replenisher at the media terminal by presenting the expected media count as a cash amount on a service display of the media terminal for confirmation by a user;

in response to receiving an entry from the media replenisher that indicates that the actual media present does not correspond to the expected media count, receiving information from the media replenisher at the media terminal indicating the actual amount of media present and updating a media count using the information, wherein the actual media is actual cash.

2. A method according to claim 1, wherein receiving an expected media count from a remote management application is implemented by a management agent receiving the expected media count.

3. A method according to claim 2, wherein providing the expected media count to the media replenisher is implemented by (i) the management agent communicating the expected media count to a local application, and (ii) the local application populating a screen with the expected media count when the media replenisher selects a media replenishment function using the local application.

4. A method according to claim 1, wherein detecting a media replenisher at the media terminal is implemented by sensing a menu selection relating to media replenishment.

5. A method according to claim 1, wherein the method comprises:

(i) updating a media count using the expected media count if the expected media count is confirmed by the media replenisher.

6. A method according to claim 1, wherein the remote management application implements a media optimization function to advise how much media should be located at the media terminal.

7. A method according to claim 6, wherein the remote management application implements a media terminal management function so that the remote management application receives event and fault information from the media terminal, and may dispatch a service engineer to service the media terminal.

8. A method according to claim 1, wherein the method comprises the further step of transmitting the actual amount of media present to a remote transaction host.

9. A method according to claim 1, wherein the method further comprises updating a local application with the actual amount of media present.

10. A media terminal comprising:

(i) a media dispenser, (ii) a service application operable to provide service functions to an authorized user of the terminal and operable to:

(a) receive an expected media count from a remote management application, where the expected media count is the amount of cash needed by the media terminal for operation;

(b) detect a media replenisher at the terminal;

(c) provide the expected media count to the media replenisher at the media terminal by presenting the expected media count as a cash amount on a service display of the media terminal for confirmation by the authorized user;

(d) in response to receiving an entry from the media replenisher that indicates that an actual media present does not correspond to the expected media count, receiving information from the media replenisher at the media terminal indicating the actual amount of media present, wherein the actual media is actual cash.

11. A media terminal according to claim 10, wherein the service application includes a management agent executing on the terminal and operable to communicate with software associated with the media dispenser.

12. A media terminal according to claim 11, wherein the management agent comprises: an agent core, and a transfer service.

13. A media terminal according to claim 10, wherein the media terminal comprises a self-service terminal.

14. A media terminal according to claim 13, wherein the self-service terminal comprises an automated teller machine.

15. A media terminal according to claim 10, wherein the service application includes a supervisor application operable to enable an authorized user to configure and maintain the media terminal.

16. A media terminal according to claim 10, wherein the service application is further operable to:

update a media count using the expected media count if the expected media count was confirmed by the media replenisher, or update a media count using the information from the media replenisher indicating the actual amount of media present, if the expected media count was annulled by the media replenisher.

17. A media terminal according to claim 10, wherein the remote management application implements a media optimization function to advise how much media should be located at the media terminal.

18. A management agent for executing on a media terminal comprising a media dispenser device, wherein the management agent is programmed to:

(i) receive an expected media count from a remote management application, where the expected media count is the amount of cash needed by the media terminal for operation;

(ii) provide the expected media count to a media replenisher at the media terminal by presenting the expected media count as a cash amount on a service display of the media terminal for confirmation by a user;

(iii) receive an entry from the media replenisher that indicates that an actual media present does not correspond to the expected media count, wherein the actual media is actual cash, and (iv) receive information from the media replenisher indicating the actual amount of media present.

* * * * *